US007887135B2

(12) United States Patent
Oda

(10) Patent No.: US 7,887,135 B2
(45) Date of Patent: Feb. 15, 2011

(54) HEADREST DEVICE IN A CHAIR

(75) Inventor: Yoichiro Oda, Yokohama (JP)

(73) Assignee: Okamura Corporation (JP)

( * ) Notice: Subject to any disclaimer, the term of this patent is extended or adjusted under 35 U.S.C. 154(b) by 130 days.

(21) Appl. No.: 12/085,009

(22) PCT Filed: Nov. 7, 2006

(86) PCT No.: PCT/JP2006/322171

§ 371 (c)(1),
(2), (4) Date: May 13, 2008

(87) PCT Pub. No.: WO2007/055201

PCT Pub. Date: May 18, 2007

(65) Prior Publication Data

US 2008/0309139 A1 Dec. 18, 2008

(30) Foreign Application Priority Data

Nov. 14, 2005 (JP) ..... 2005-328349
May 9, 2006 (JP) ..... 2006-130545
May 12, 2006 (JP) ..... 2006-134444

(51) Int. Cl.
*A47C 7/36* (2006.01)

(52) U.S. Cl. ..... 297/410; 297/396; 297/440.21

(58) Field of Classification Search ..... 297/396, 297/410, 397, 400, 391, 440.21
See application file for complete search history.

(56) References Cited

U.S. PATENT DOCUMENTS 56,718 A * 7/1866 Coomes ..... 297/107
2,525,126 A * 10/1950 Greitzer ..... 297/452.38
5,938,285 A * 8/1999 Verbeek ..... 297/353
6,273,509 B1 * 8/2001 Reithmeier et al. ..... 297/410
6,394,552 B1 * 5/2002 Su ..... 297/410
6,616,236 B1 * 9/2003 Su ..... 297/410
6,695,408 B1 * 2/2004 Nobbe ..... 297/440.11
6,793,286 B2 * 9/2004 Burgin ..... 297/353
7,055,903 B2 * 6/2006 Balensiefer et al. .... 297/256.11
7,322,647 B2 * 1/2008 Munn et al. ..... 297/250.1

FOREIGN PATENT DOCUMENTS

JP 2001-314268 11/2001
JP 2003-79474 3/2003
JP 2004-202062 7/2004

* cited by examiner

*Primary Examiner*—Sarah B McPartlin
(74) *Attorney, Agent, or Firm*—Skinner and Associates

(57) ABSTRACT

A headrest device of a chair in which a headrest can be stably supported by a headrest frame and the operation for mounting a vertically moving member of the headrest is easily performed. Guide grooves are formed in the side faces of guide rails at the front faces of the right and left side-rods of the headrest frame. The right and left guide rails are so held by a pair of right and left lifting brackets, which are provided on the rear surface of the headrest and are formed in rearward U-shape when viewed from above, as to be capable of sliding vertically from the front. Projected guide pieces formed to be projected on the inner surfaces of both vertically moving brackets and facing in the vertical direction are slidably fitted into the guide grooves of the right and left guide rails.

10 Claims, 7 Drawing Sheets

HEADREST DEVICE IN A CHAIR

TECHNICAL FIELD

The present invention relates to a headrest device in a chair, comprising a headrest supported by a headrest frame extending upward from a backrest support frame to move up and down.

BACKGROUND OF THE INVENTION

Such a headrest device is disclosed in JP2001-314268A, JP2003-79474A and JP2004-202062A.

JP2001-314268A discloses a headrest device in which a headrest is mounted in the middle of an upper lateral rod of a backrest support frame. The headrest is not so strongly supported and each side is unstable.

JP2003-79474A discloses a headrest device in which a headrest is mounted to a headrest rod projecting from the backrest, and JP2004-202062A discloses a headrest device in which a headrest frame is supported in the middle of a backrest support frame to move up and down, a headrest being mounted in the middle at the upper end of the headrest frame. But in both of the headrest devices, when the headrest moves up away from the backrest support frame, a support strength is not sufficient and the headrest and support therefore+ are likely to be unstable.

In an elevating member for supporting the headrest in the headrest device in JP2003-79474A, C-like sectioned engagement grooves of right and left ends engage with right and left side rods of a headrest frame, and an engagement projection on the side rod selectively engages in the engagement groove allowing the headrest so that the headrest may move up and down. For mounting the elevating member, the side rods of the headrest frame have to be elastically changed in shape outward and sideward by a strong force to increase a gap between opposing surfaces to make mounting troublesome.

When the headrest moves up and down, the elevating member is pressed and pulled up and down by strong forces. It is necessary to engage an engagement projection in a groove by expanding the headrest frame elastically. It would be very difficult to move the headrest up and down easily. Also the engagement projection strongly rubs against the groove to cause wear and loosening.

A plurality of engagement grooves is formed in a hole, for which a lateral rod is required. The elevating member becomes larger. So appearance becomes poor and it would be very difficult to design the elevating member itself and the headrest device freely.

SUMMARY OF THE INVENTION

In view of the disadvantages, it is an object of the present invention to provide a headrest device in which a headrest is stably supported on a headrest frame to move up and down, an elevating member for the headrest being easily assembled to the headrest frame.

It is another object of the invention to provide a headrest device in which the headrest is easily movable up and down, an elevating member for the headrest being made as small as possible.

It is further object of the invention to provide a headrest device in which a headrest frame has high strength to allow the headrest to be supported stably.

THE BEST MODE FOR CARRYING OUT THE INVENTION

Figure 1:
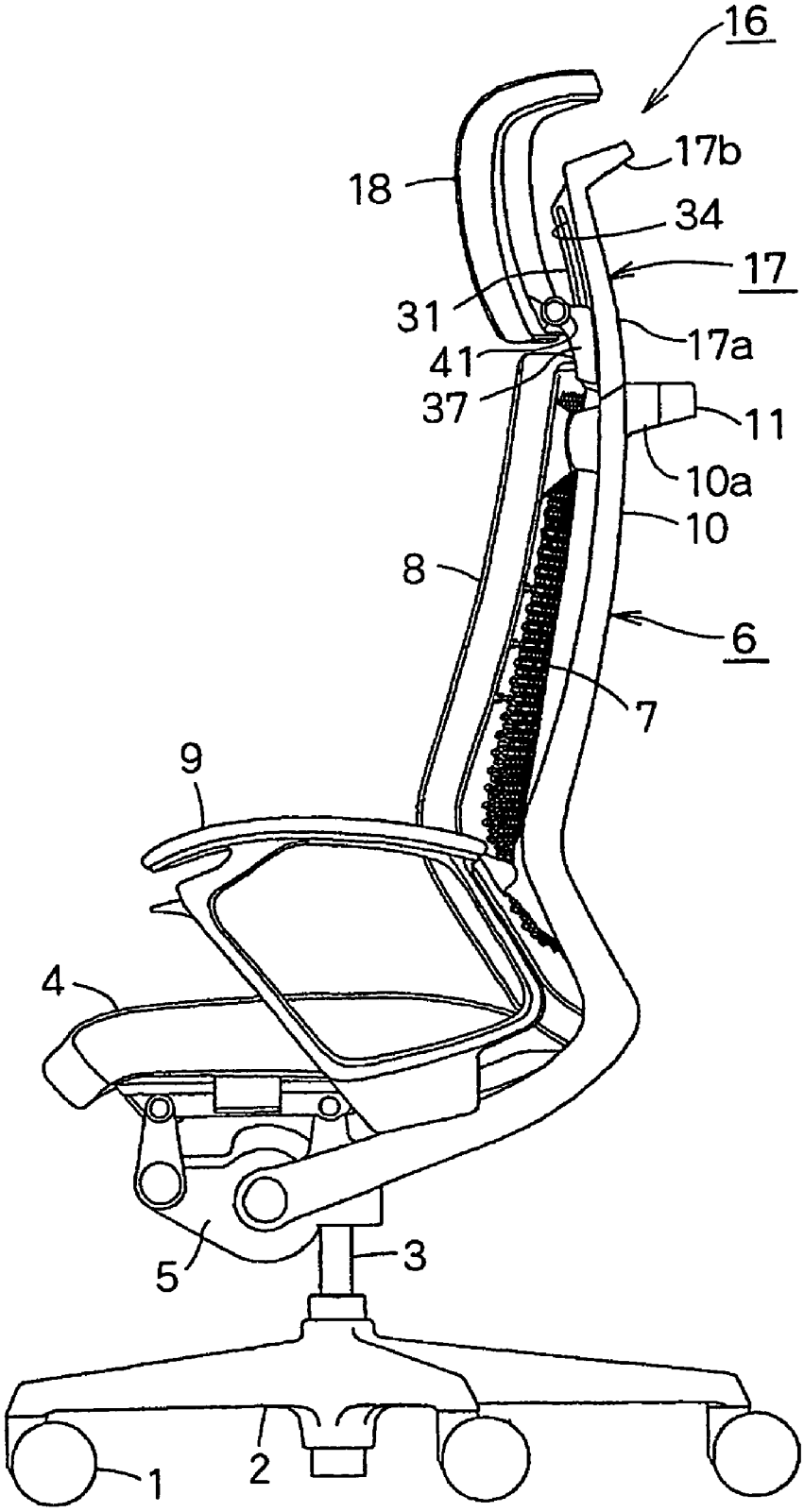
FIG. 1 is a side elevational view of a chair comprising an embodiment of a headrest device according to the present invention.
Figure 2:
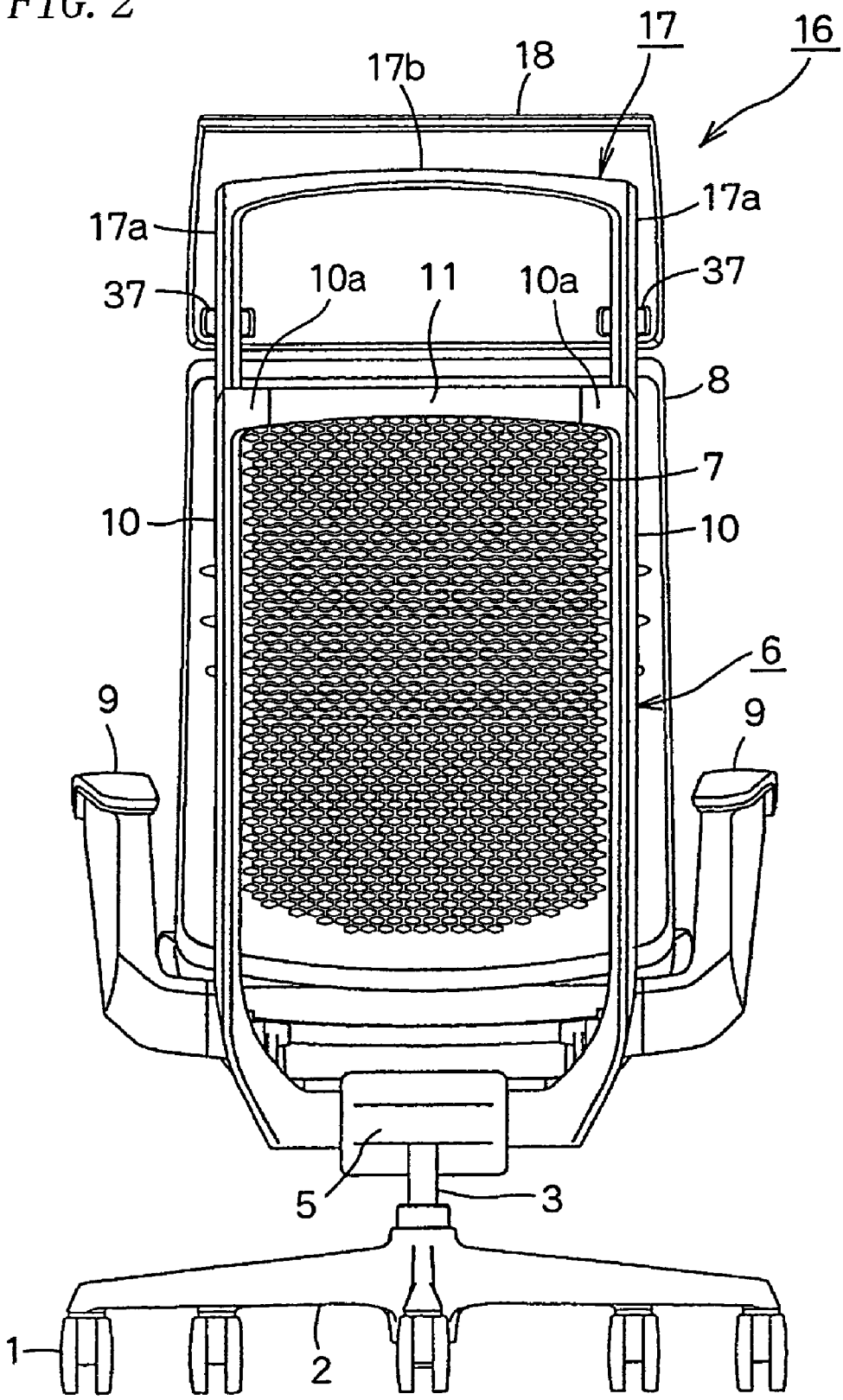
FIG. 2 is a rear elevational view thereof.

FIG. 1 is a side elevational view of a chair comprising a headrest according to the present invention and FIG. 2 is a rear elevational view thereof. The chair comprises a leg 2 with casters 1; a post 3 standing on the middle of the leg 2; a support base 5 supporting a seat 4 at the upper end; a backrest support frame 6 which is pivotally connected to the support base 5 and stands at the rear end of the seat 4; and a pair of armrests 9,9 at the lower parts of the backrest support frame 6.

A mesh backrest plate 7 of the backrest 8 is mounted on the front surface of the backrest support frame 6.

Figure 3:
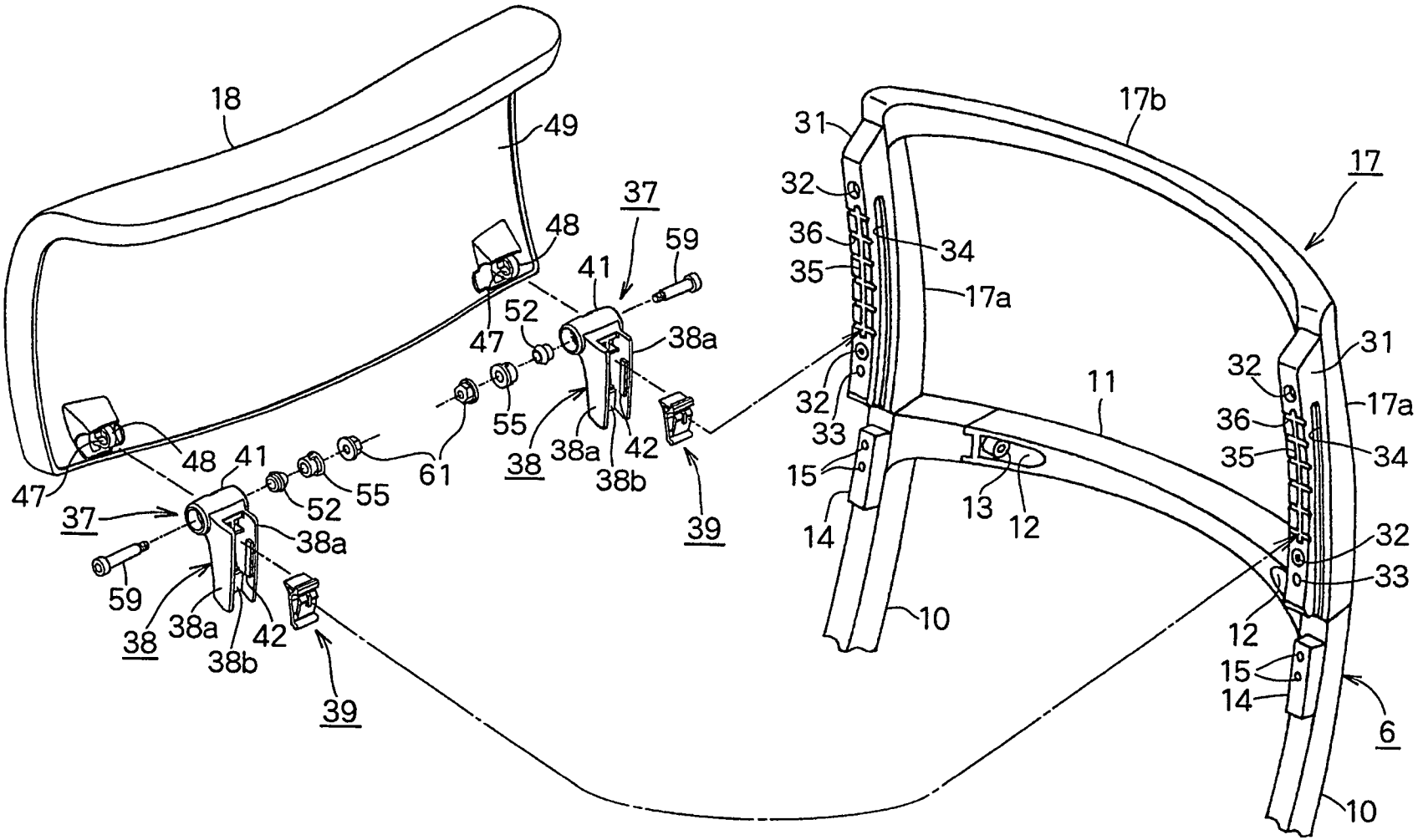
FIG. 3 is an exploded perspective view of the headrest device.

In FIG. 3, the inverse-U-like backrest support frame 6 comprises a pair of side portions 10,10 molded of Al alloy; and a lateral portion 11 molded of Al alloy.

Connecting portions 10*a*,10*a* project at the upper ends of the side portions 10 and are continuously formed with the lateral portion 11.

At each end of the lateral portion 11, a groove 12 is formed and a bolt 13 is disposed in the groove 12. The bolt 13 engages in a female bore (not shown) of the connecting portion 10*a* through the side end of the lateral portion 11. Thus, the lateral portion 11 is coupled to the upper end of the side portion 10 close to the upper end of the backrest 8, providing good appearance.

Figure 4:
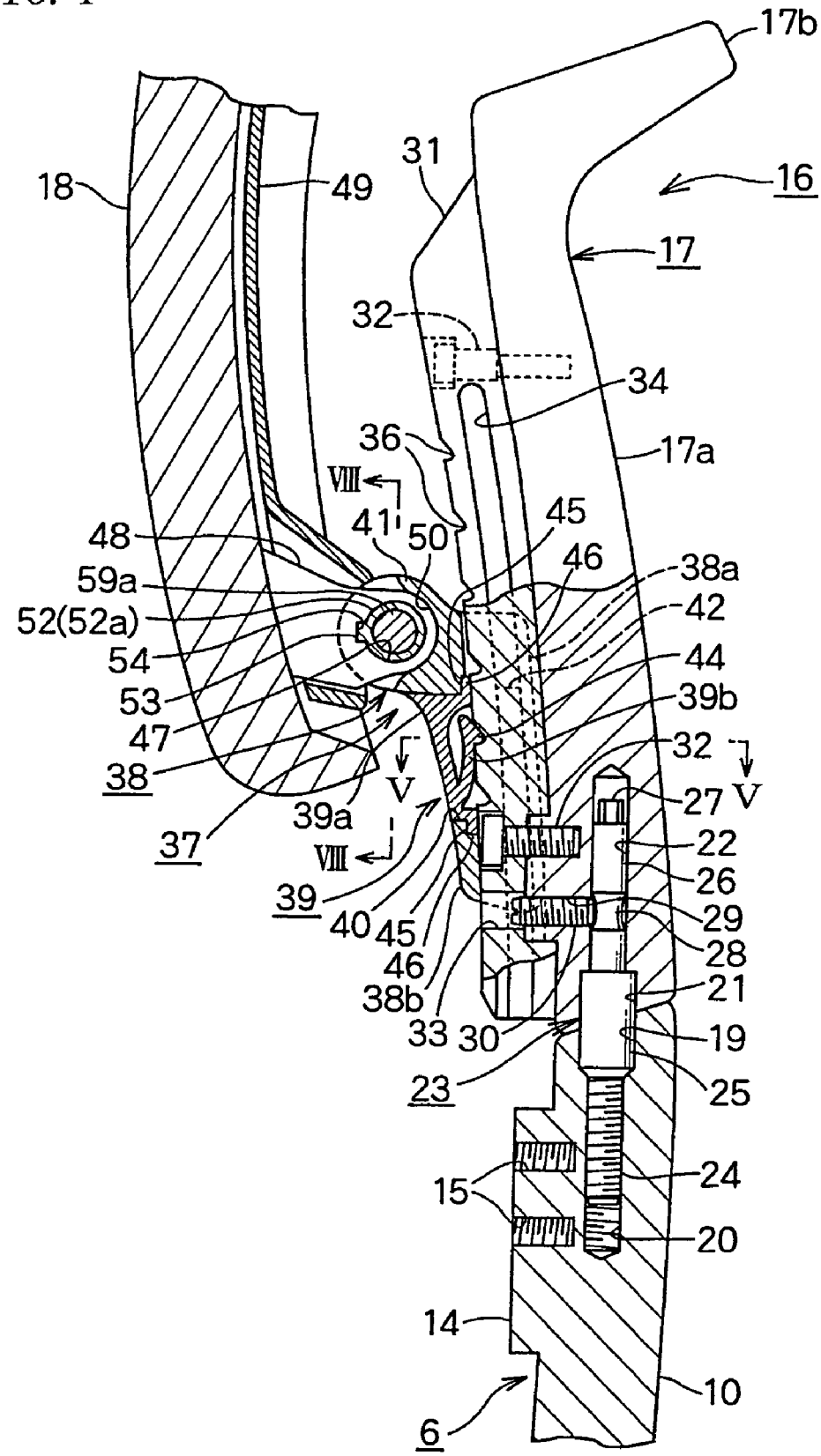
FIG. 4 is an enlarged partially cutout side view thereof.

The upper end of the backrest plate 7 is coupled to the front surface of the backrest support frame 6 with a pair of projections 14,14 each of which has two female bores 15 in FIG. 4.

A headrest device 16 according to the present invention is provided on the upper end of the backrest support frame 6.

The headrest device 16 comprises an inverse-U-like headrest frame 17 made of Al alloy and a headrest 18 over the front surface of the headrest frame 17.

In FIG. 3, the headrest frame 17 comprises a pair of side rods 17*a*,17*a* and a lateral rod 17*b*. A distance between the side rods 17*a* and 17*a* is nearly equal to that between the side portions 10 and 10.

The cross-sectional area of the lower end of the side rod 17*a* is nearly equal to the cross-sectional area of the upper end of the side portion 10 providing one-body appearance after assembling.

The headrest frame 17 is coupled to the upper end of the backrest support frame 6.

In FIG. 4, in the upper end of the side portion 10 of the backrest support frame 6, a larger-diameter connecting hole 19 communicates with a smaller-diameter connecting bore 20 longer than the connecting hole 19.

A vertical metal connecting shaft 23 comprises a screw shaft 24 at the lower end; a larger-diameter shaft 25; an upper connecting shaft 26 smaller in diameter than the larger-diameter shaft 25; and a short hexagonal shaft 27 at the upper end.

The vertical distance of the connecting shaft 26 and the hexagonal shaft 27 is slightly shorter than that of the connecting bore 22.

The screw shaft 24 engages with the female bore 20 of the side portion 10. Lower and upper halves of the larger-diameter shaft 25 engage in the larger-diameter connecting hole 19 of the side portion 10 and the larger-diameter connecting hole 21 of the side rod 17*a* respectively. The upper connecting shaft 26 and the hexagonal shaft 27 engage in the connecting hole 22 of the side rod 17*a*.

A narrow part 28 is formed in the middle of the outer circumferential surface of the upper connecting shaft 26.

To mount the headrest frame 17 to the backrest support frame 6, the screw shaft 24 of the connecting shaft 23 is screwed in the female bore 20 of the side portion 10 until the lower end of the larger-diameter shaft 25 contacts the bottom of the larger-diameter connecting hole 19, so that the connecting shaft 23 is mounted such that more than upper half of the larger-diameter shaft 25 projects from the upper end of the side portion 10.

By turning the hexagonal shaft 27 at the upper end of the connecting shaft 23 with a tool such as a spanner, the screw shaft 24 can easily be screwed in the female bore 20. By tightening the hexagonal shaft 27, the lower end of the larger-diameter shaft 25 can be strongly contacted on the bottom of the larger-diameter hole 19 to allow the connecting shaft 23 to be mounted to the side portion 10 firmly.

Then, the lower end of the side rod 17*a* of the headrest frame 17 faces the upper end of the side portion 10. The larger-diameter connecting hole 21 and the connecting hole 22 at the lower end of the side rod engages with a projection of the connecting shaft 23 or an upper half of the larger-diameter shaft 25 and the upper connecting shaft 26.

A slitting set screw 30 is put into a female bore 29 through a through hole 33 of a guide rail 31 and presses on the narrow part 28 of the connecting shaft 23.

The side rod 17*a* is fixed to the connecting shaft 23, so that the lower end of the headrest frame 17 is mounted to the upper end of the backrest support frame 6. Opposing surfaces of the side portion 10 and the side rod 17*a* are tilted down forward at the same angle to increase an interconnecting area between the opposing surfaces and to receive rearward load to the headrest frame 17 effectively, thereby preventing the headrest frame 17 from loosening at the connecting portion and ensuring a firm connection to the backrest support frame 6.

In FIGS. 3 and 4, on the front surfaces of the side rods 17*a* of the headrest frame 17, a pair of synthetic-resin guide rails 31,31 is mounted with upper and lower bolts 32 to support and vertically guide the headrest 18.

At the lower end of the guide rail 31, the through hole 33 through which the set screw 30 is put is formed.

Figure 5:
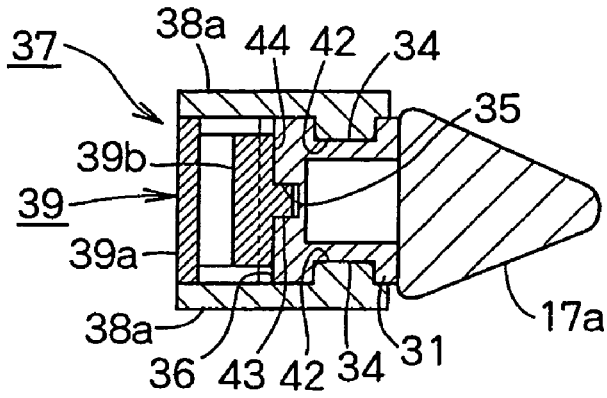
FIG. 5 is an enlarged horizontal sectional plan view taken along the line V-V in FIG. 4.

A pair of first guide grooves 34,34 is formed on each side of the guide rail 31 to open at the lower end in FIG. 5.

On the front surface of each of the guide rails 31, a second guide groove 35 extends vertically and a plurality of engagement grooves 36 extends horizontally perpendicular to the guide groove 35. The engagement groove 36 is slightly shallower than the second guide groove 35.

A pair of elevating brackets 37,37 which goes up and down and supports the headrest 18 is mounted to the right and left guide rails 31 as below.

In FIGS. 3-5, the elevating bracket 37 comprises a rigid bracket body 38 made of fiber-reinforced synthetic resin; and an engagement member 39 made of softer synthetic resin such as polyacetal resin.

The bracket body 38 comprises a pair of side parts 38*a*,38*a* and a front part 38*b* having a rectangular opening 40 to form a U shape. At the upper ends of the side parts 38*a*, a support tube 41 is provided. A distance between the side parts 38 and 38 is nearly equal to a width of the guide rail 31.

A pair of first guide projections 42,24 is formed in the middle of opposing surfaces of the side parts 38*a* and is in sliding contact with the first guide groove 34 of the guide rail 31.

Figure 6:
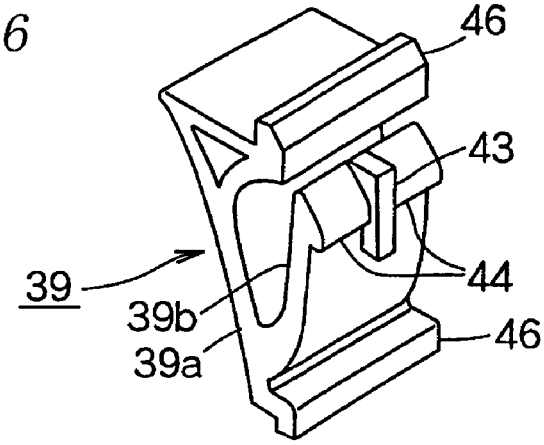
FIG. 6 is an enlarged perspective view of an engagement member.

In FIG. 6, the engagement member 39 comprises a base 39*a* engagable in the rectangular opening 40 of the front part 38*b*; and an elastic portion 39*b* standing from the lower end of the base 39*a*. At the upper end of the elastic portion 39*b*, a guide projection 43 is in sliding contact with the second guide groove 35 of the guide rail 31 to move up and down, and engagement projections 44,44 selectively engage in the engagement grooves 36 of the guide rail 31.

At the upper and lower ends of the base 39*a*, holding portions 46,46 engages with engagement steps 45,45 on upper and lower edges of the rectangular opening 40 on the rear surface of the front part 38*b* to prevent the engagement member 39 from coming out of the opening 40.

In order that the elevating bracket 37 may be mounted to the guide rail 31, the engagement member 39 is engaged in the rectangular opening 40 of the front part 38*b* of the bracket body 38. Then, the first guide projections 42,42 of the side part 38*a* is engaged from the lower opening end of the first guide grooves 34,34 of the guide rail 31. At the same time, the rear surface of the upper end of the elastic portion 39*b* is pressed on the front surface of the lower part of the guide rail 31 and bent forward, and the elevating bracket 37 slides upward, so that the second guide projection 43 of the elastic portion 39*b* engages in the second guide groove 35 of the guide rail 31.

Accordingly, the elevating bracket 37 moves up and down along the guide rail 31. The second guide projection 43 contacts the lower end of the second guide groove 35 thereby preventing the bracket 37 from falling out and limiting a downward motion. The first guide projection 42 contacts the upper end of the first guide groove 34 thereby limiting an upward motion of the bracket 37.

The elevating bracket 37 is moved up and down and the elastic portion 39*b* is elastically changed in shape back and forth. Thus, the engagement projection 22 selectively engages in any one of the engagement grooves 36 in the front surface of the guide rail 31 thereby adjusting the height of the headrest 18 mounted to the elevating bracket 37.

In FIGS. 3 and 4, at the lower side ends of the headrest 18, a pair of mounting portions 48,48 having a hole 47 is mounted to go through a back cover 49.

Figure 8:
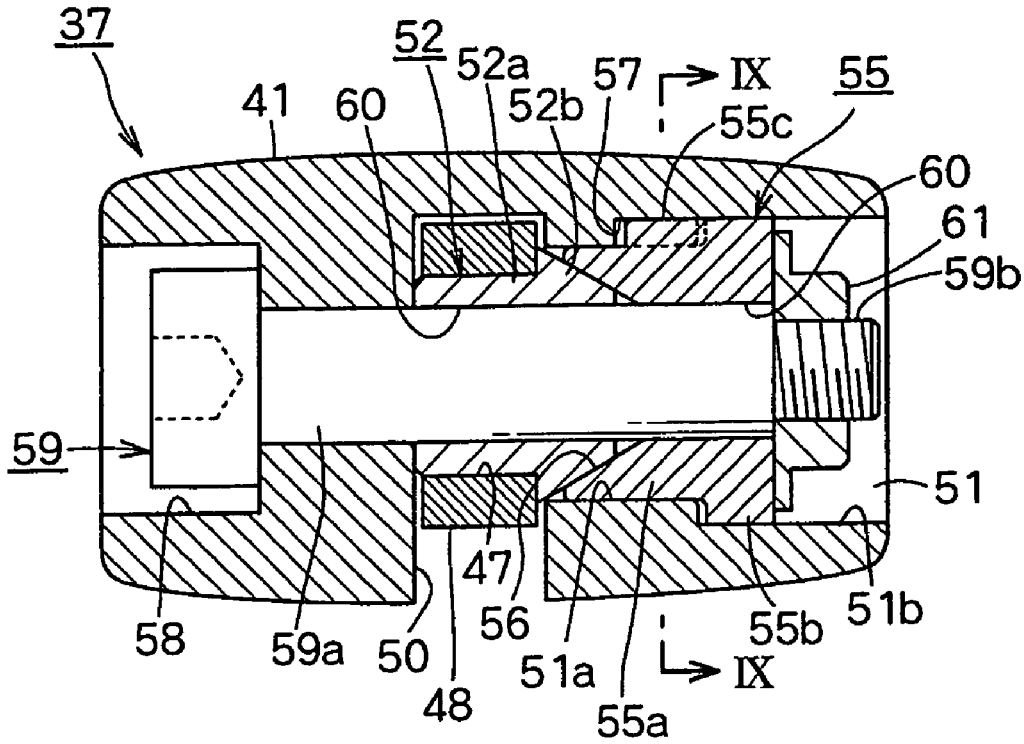
FIG. 8 is an enlarged vertical sectional end view taken along the line VIII-VIII in FIG. 4.

In FIG. 8, in the front surface of the support tube 41 of the elevating bracket 37, a mounting groove 50 engages with the rear end of the mounting portion 48 with a play to allow the mounting portion to rotate.

In FIGS. 3 and 8, in the mounting hole 47 of the mounting portion 48 which engages in the mounting groove 50 with a play, a cylindrical portion 52*a* of a friction-applied member 52 engages. The friction-applied member 52 is put into a stepped hole 51 communicating with the mounting groove 50. The friction-applied member 52 has a conical portion 52*b* in which external diameter of the inner end is larger than an external diameter of the cylindrical portion 52*a*. The member 52 is molded of rigid synthetic resin such as polyacetal resin.

Figure 7:
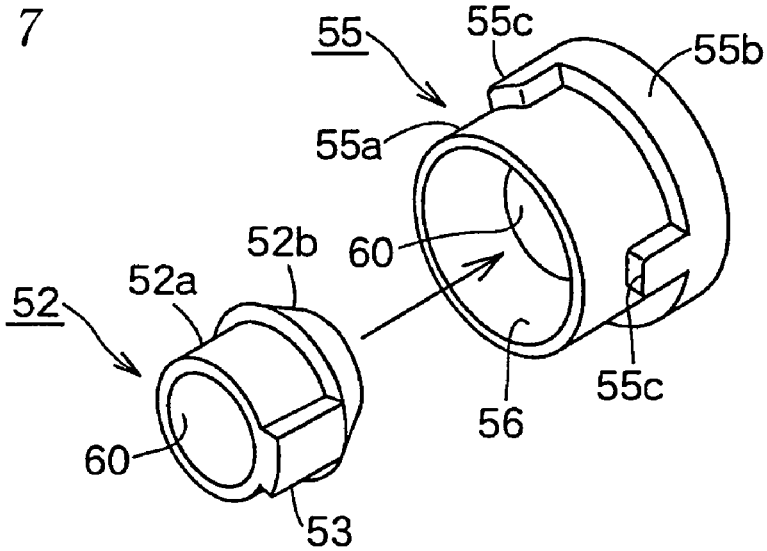
FIG. 7 is an enlarged front perspective view of a friction-applying member and a friction-applied member.

In FIG. 7, a projection 53 is provided on the outer circumferential surface of the cylindrical portion 52*a*. In FIG. 4, the projection 53 engages in a groove 54 in the inner surface of the mounting hole 47 to prevent the friction-applied member 52 from rotating with the mounting portion 348.

Figure 9:
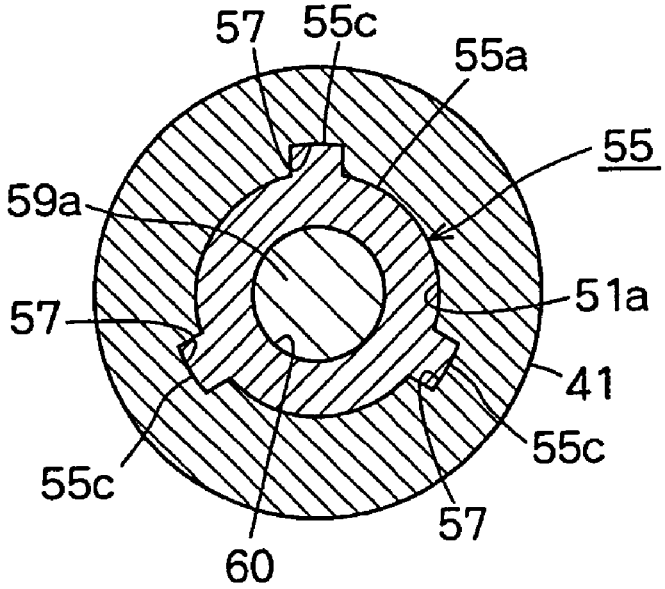
FIG. 9 is a vertical sectional side view taken along the line IX-IX in FIG. 8.

In FIGS. 7-9, a friction-applying member 55 comprises a smaller-diameter cylindrical portion 55*a* engaging in a smaller-diameter portion 51*a* of the stepped hole 51 of the support tube 41; a short brim 55*b* engaging in a larger-diameter portion 51*b* of the stepped hole 51; and three projections 55*c* circumferentially spaced at 120 degrees on the outer circumferential surface of the inner end of the larger-diameter brim 55*b* and the middle of the smaller-diameter cylindrical portion 55*c*.

At the inner end of the smaller-diameter cylindrical portion 55*a*, a taper hole 56 engages with the conical portion 52*b* of the friction-applied member 52.

The three projections 55*c* engages in the three grooves 57 in the inner circumferential surface of the smaller-diameter portion 51*a* of the stepped hole 51 to prevent the member 55 from rotating with the support tube 41.

The friction-applying member 55 molded of elastic synthetic resin is softer than the friction-applied member 52 such as polyurethane elastomer.

In the mounting portion 48, friction-applied member 52 and friction-applying member 55, a shaft 59*a* of a stepped bolt 59 put in from the stepped hole 58 is put through an axial hole 60 having an equal diameter to the members 52,55. A nut 61 engages on a male thread 59*b* projecting in the stepped hole 41 to allow the mounting portion 48 and members 52,55 to be mounted to the support tube 41 or elevating bracket 37. After mounting, the side end of the cylindrical portion 52*a* of the friction-applied member 52 contacts the mounting groove 50, and the outer circumferential surface of the conical portion 52*b* contacts the inner surface of the taper hole 56 of the friction-applying member 55 to enable rotation to each other.

In order that the inner surface of the taper hole 56 may slightly change elastically and radially outward, interference and tightening force of the friction-applying member 55 by the nut 61 may be preferably set to allow the inner surface of the taper hole 56 to press the outer circumferential surface of the conical portion 52*b* strongly. Thus, the frictional resistance of the contact surface becomes larger, so that the friction-applied member 52 with relatively high frictional force turns with respect to the friction-applied member 55.

It increases rotational resistance of the mounting portion 48 and headrest 18 being substantially integral with the friction-applied member 52, thereby allowing a position and an angle of the headrest 18 to the backrest to be adjusted continuously and preventing rotation.

Figure 10:
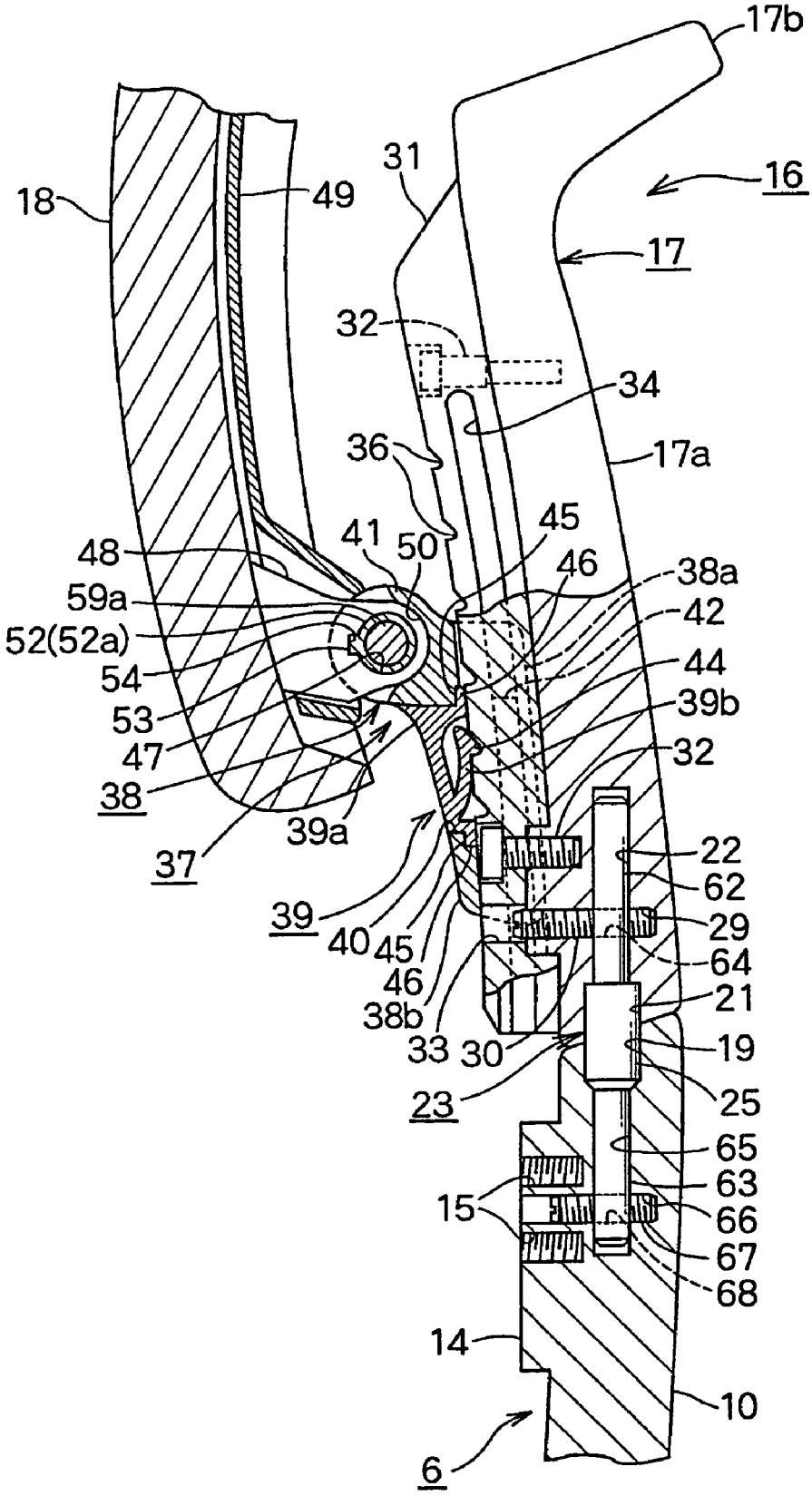
FIG. 10 is a partially cutaway side view similar to FIG. 4, showing a variation of a connection of a backrest support frame with a headrest frame.

FIG. 10 shows a variation of a connection of a backrest support frame 6 with a headrest frame 17.

In the variation, a connecting shaft 23 has straight smaller-diameter shafts 62,63 at upper and lower sides of a larger-diameter shaft 25. The upper smaller-diameter shaft 62 is put in a connecting hole 22, and a screw 30 is put through a female bore 29 of a side rod 17*a* to allow the screw 30 to engage in a female bore 64 of the smaller-diameter shaft 62, so that the shaft 62 is fixed. The lower smaller-diameter shaft 63 is put in a smaller-diameter hole 65 of a side frame 10, and a screw 67 which engages in a female bore 66 of the side frame 10 is engaged in a female bore 68 of the shaft 63, so that the shaft 63 is fixed.

As mentioned above, in the headrest device 16 in the embodiments, the elevating bracket 37 supporting the headrest 18 is U-shape and holds the guide rail 31 on the front surface of the side rod 17*a* of the headrest frame 17. The two first guide projections 42 on the inner side surfaces of the side portions 38*a* of the bracket body 38 is in sliding engagement with the first guide groove 34 of the guide rail 31 enabling the headrest 18 to move up and down along the side rods 17*a* of the headrest frame 17 while the headrest 18 is stably supported.

The second guide groove 35 is formed in the middle on the front surface of the guide rail 31 which slidably engages with the second guide projection 43 on the elastic portion 39*b* of the engagement member 39 between the side parts 38*a* of the elevating bracket 37, allowing the headrest 18 to move up and down stably.

Furthermore, the headrest 18 is supported by the guide rails 31 on the front surfaces of the side rods 17*a* of the headrest frame 17 via the elevating brackets 37 to enable the headrest device 16 including the elevating bracket 37 and headrest frame 17 to be designed more freely.

The first guide groove 34 opens at the lower end in which the first guide projection 42 easily engages thereby facilitating assembling the elevating bracket 37 to the guide rail 31.

The second guide projection 43 projects from the upper end of the rear surface of the elastic portion 39*b* elastically changing in shape back and forth to enable easy engagement in the second guide groove 35. After engagement, the second guide projection 43 contacts the lower end of the second guide groove 35 thereby preventing the elevating bracket 37 and the headrest 18 from coming off the guide rail 31.

The second guide groove 35 and a plurality of engagement grooves 36 perpendicular thereto are formed in the front surface of the guide rail 31. The second projection 43 on the elastic portion 39*b* engages in the second guide groove 35 and the engagement projection 44 engages in the engagement groove 36 to enable the engagement projection 44 to engage in the engagement groove 36 surely and stably.

When the engagement projection 44 disengages from the engagement groove 36, the elastic portion 39*b* bends forward. Thus, when the headrest 18 goes up, the side rods 17*a* of the headrest frame 17 is not subjected to bending load. The headrest 18 can be moved up and down by a weak force.

The elevating bracket 37 comprises the U-like rigid bracket body 38 holding the guide rail 31; and the engagement member 39 comprising the engagement projection 44 engaging in the engagement groove 36 of the guide rail 31. The engagement member 39 is detachably held in the rectangular hole 40 of the front portion 38*b* of the bracket body 38. When the engagement projection 44 wears out, the elevating bracket 37 is removed with the headrest 18 from the lower end of the guide rail 31 allowing the engagement member 39 only to be replaced.

The engagement member 39 held in the rectangular hole 40 of the rigid bracket body 38 can be moved up and down stably together with the bracket body 38.

In the embodiment, the guide rail 31 is separately provided from the headrest frame 17 for replacement when it wears, but the guide rail 31 is integrally formed on the side rod 17*a*.

The second guide groove 35 and engagement groove 36 may be one of the side rods 17*a*. The elevating bracket 37 may be other shapes.

Unlike the foregoing embodiments, the second guide groove 35 and engagement groove 36 may be formed in the rear surface of the elevating bracket 37, while the elastic portion 39*b* comprising the second guide projection 42 and engagement projection 44 may be formed on the front surface of the guide rail 31. The elastic portion 39*b* may b suspended down.

In the embodiments, the first guide groove 34 is formed at each side of the guide rail 31, but may be an inner or outer side only. The first guide projection 42 of the elevating bracket 37 may be one side.

The headrest frame 17 is not separately provided, but may be integrally formed with the backrest support frame 6 of the backrest 8.

In order that the elevating bracket 37 may not be removed from the guide rail 31, a pin may pass through the lower end of the first guide groove 34.

What is claimed is:

1. A headrest device in a chair, comprising:

a headrest;

a headrest frame extending upward from a backrest support frame over which a backrest is mounted, the headrest frame comprising a pair of side rods;

a vertical guide rail on each of the pair of side rods of the headrest; and a u-shaped elevating bracket on the headrest, a vertical front guide groove and a plurality of engagement grooves being formed on one of the guide rail and elevating bracket, an elastic portion being provided on the other and having a vertical projection that slides in the front guide groove and an engagement projection that selectively engages in one of the engagement groove, wherein the front guide grooves and the plurality of engagement grooves are formed on a front face of the guide rail, the U-shaped elevating bracket sliding up and down to hold the guide rail, the elastic portion that projects from a rear face of the elevating bracket pressing a front face of the guide rail to allow a pair of guide projections projecting from an inner side surface of the elevating bracket to slip up and down in a side guide groove on each side of the guide rail, and wherein the side guide groove of the guide rail is open at a lower end, the lower end of the front guide groove of the guide rail being higher than the lower end of the side guide groove.

2. The headrest device of claim 1 wherein the plurality of engagement grooves and engagement projections extend horizontally.

3. The headrest device of claim 1 wherein the elastic portion is provided on the rear face of the elevating bracket, the guide projection and engagement projections being provided on a rear face of the elastic portion.

4. The headrest device of claim 1 wherein there are a pair of guide rails and a pair of elevating brackets.

5. The headrest device of claim 1 wherein the headrest frame is in the shape of an inverted U, the guide rail being part of the side rod.

6. A headrest device in a chair, comprising:

a backrest support frame over which a backrest is mounted on a front face, the backrest support frame comprising a pair of vertical side frames and a horizontal connecting frame for connecting the pair of side frames to each other;

a headrest;

a U-shaped headrest frame over which the headrest is mounted, the headrest frame comprising a pair of side rods, lower ends of the pair of side rods being coupled to upper ends of the pair of side frames of the backrest support frame, wherein connecting holes are formed in the side frame and side rod respectively, a connecting shaft being put through the connecting holes to allow the backrest support frame to be fixed to the headrest frame with a fixing member, and wherein the connecting shaft comprises smaller-diameter shafts and a larger-diameter shaft between the shafts, upper and lower halves of the larger-diameter shaft fitting in larger-diameter holes of the side rod and side frame, the upper and lower smaller-diameter shafts fitting in smaller-diameter holes that communicate with the larger-diameter holes.

7. The headrest device of claim 6 wherein the an interface between the side portion and the side rod is tilted forward and downward.

8. The headrest device of claim 6 wherein the fixing member comprises a screw that engages in the connecting shaft through the side portion and side rod.

9. The headrest device of claim 6 wherein the smaller diameter shafts comprise an upper smaller-diameter connecting shaft, a lower smaller-diameter screw shaft and the larger-diameter shaft between the two smaller-diameter shafts the upper connecting shaft fitting in a smaller-diameter connecting hole that communicates with the larger-diameter hole of the side rod, the smaller-diameter screw shaft engaging in a female bore that communicates with the larger-diameter hole of the side portion, the upper connecting shaft being fixed with a screw through the side rod.

10. A headrest device in a chair, comprising:

a backrest support frame over which a backrest is mounted on a front face, the backrest support frame comprising a pair of verticle side portions and a lateral portion connecting upper ends of the pair of side portions to each other;

a headrest;

a U-shaped headrest frame over which the headrest is mounted, the headrest frame comprising a pair of side rods, lower ends of the pair of side rods being coupled to upper ends of the pair of side portions of the backrest support frame, wherein connecting holes are formed in the side portion and side rod respectively, a connecting shaft being put through the connecting holes to allow the backrest support frame to be fixed to the headrest frame with a fixing member, wherein the connecting shaft comprises an upper smaller-diameter connecting shaft, a lower smaller-diameter screw shaft and a larger-diameter shaft between the two smaller-diameter shafts, upper and lower halves of the larger-diameter shaft fitting in larger-diameter holes of the side rod and side portion, the upper connecting shaft fitting in a smaller-diameter connecting hole that communicates with the larger-diameter hole of the side rod, the smaller-diameter screw shaft engaging in a female bore that communicates with the larger-diameter hole of the side portion, the upper connecting shaft being fixed with a screw through the side rod.

* * * * *